US008286367B2

(12) United States Patent
Kendall et al.

(10) Patent No.: US 8,286,367 B2
(45) Date of Patent: Oct. 16, 2012

(54) SYSTEM AND METHOD FOR CONTINUOUS DRYING OF WOOD PIECES

(75) Inventors: James Kendall, Trois-Rivières (CA); Sylvain Chénard, Notre-Dame-du-Mont-Carmel (CA); Vincent Lavoie, Québec (CA)

(73) Assignee: Hydro-Quebec, Montreal, Quebec (CA)

( * ) Notice: Subject to any disclaimer, the term of this patent is extended or adjusted under 35 U.S.C. 154(b) by 530 days.

(21) Appl. No.: 12/452,524

(22) PCT Filed: Jul. 9, 2008

(86) PCT No.: PCT/CA2008/001258

§ 371 (c)(1),
(2), (4) Date: Jan. 6, 2010

(87) PCT Pub. No.: WO2009/006737

PCT Pub. Date: Jan. 15, 2009

(65) Prior Publication Data

US 2010/0146806 A1 Jun. 17, 2010

(30) Foreign Application Priority Data

Jul. 12, 2007 (CA) ..... 2593873

(51) Int. Cl.
*F26B 11/00* (2006.01)

(52) U.S. Cl. ..... 34/396; 34/411; 34/423; 34/201; 34/218; 73/73; 73/866; 219/773; 219/775; 104/172.3

(58) Field of Classification Search ..... 34/396, 34/411, 423, 497, 526, 201, 210, 218, 242; 219/773, 775; 73/73, 866; 104/172.3
See application file for complete search history.

(56) References Cited

U.S. PATENT DOCUMENTS 1,328,658 A * 1/1920 Fish, Jr. ..... 34/350
2,397,897 A * 4/1946 Wenger ..... 34/255
2,679,111 A * 5/1954 Leischner ..... 34/306
3,283,412 A * 11/1966 Farnsworth ..... 34/287

(Continued)

FOREIGN PATENT DOCUMENTS

DE 10114773 A1 * 10/2001

(Continued)

OTHER PUBLICATIONS

Diego Elustondo, et al., "The demonstration of increased lumber value using optimized lumber sorting and radio frequency vacuum drying", Jan. 2005, vol. 55, No. 1, pp. 76-83.

(Continued)

*Primary Examiner* — Stephen M. Gravini
(74) *Attorney, Agent, or Firm* — Muirhead and Saturnelli, LLC

(57) ABSTRACT

A system for continuous (re-)drying of wood pieces. A conveyor arrangement receives and carries the wood pieces in file following a course. A moisture content of each wood piece travelling on the conveyor arrangement is measured during the course. The wood pieces whose measured moisture content are above a target content are diverted towards a drying equipment, in particular by high-frequency, whereas the other wood pieces continue their course on the conveyor arrangement. The drying equipment removes a moisture portion from the diverted wood pieces. The moisture contents of the processed wood pieces are again measured. The pieces whose moisture content dropped below the target content are routed towards the conveyor arrangement whereas the other pieces are routed in the drying equipment for a re-drying.

20 Claims, 5 Drawing Sheets

U.S. PATENT DOCUMENTS

| | | | | |
|---|---|---|---|---|
| 4,194,296 | A * | 3/1980 | Pagnozzi et al. | 34/410 |
| 4,233,752 | A * | 11/1980 | Kleinguenther | 34/331 |
| 4,258,240 | A | 3/1981 | Pless | |
| 6,640,462 | B1 | 11/2003 | Choi et al. | |
| 6,865,821 | B2 * | 3/2005 | Merschat | 34/403 |
| 7,146,747 | B2 | 12/2006 | Studd et al. | |
| 7,676,953 | B2 * | 3/2010 | Magill | 34/282 |
| 7,963,048 | B2 * | 6/2011 | Pollard | 34/396 |
| 8,104,190 | B2 * | 1/2012 | Magill | 34/282 |
| 8,201,501 | B2 * | 6/2012 | Tinsley et al. | 104/172.3 |

FOREIGN PATENT DOCUMENTS

| | | | |
|---|---|---|---|
| JP | 55155781 | A * | 12/1980 |
| JP | 56026993 | A * | 3/1981 |
| JP | 2002028902 | | 1/2002 |
| WO | WO 02065040 | A1 * | 8/2002 |

OTHER PUBLICATIONS

Robert L. Zwick, et al., "Design Considerations of a Commercial Q-Sift Installation for Redrying Hemlock Lumber", Western Dry Kiln Association, May 2001, pp. 58-64.

* cited by examiner

SYSTEM AND METHOD FOR CONTINUOUS DRYING OF WOOD PIECES

FIELD OF THE INVENTION

The invention generally relates to the drying of wood pieces, and more particularly to a system and a method for continuous drying and/or re-drying of wood pieces.

BACKGROUND

Different techniques may be used to dry wood. The most widespread one is that of conventional drying with air-conditioned warm air. Processes under vacuum are also industrially used. One of these consists in using high-frequency vacuum kilns. Batches of wood are disposed in kilns where a partial vacuum is produced to expel the oxygen and reduce the temperatures inside the wood.

The document "Design Considerations of a Commercial Q-Sift Installation for Re-Drying Hemlock Lumber", Zwick et al., 52nd annual meeting of the Western dry Kiln Association, Reno, Nev., USA, pp. 58-64, May 2001, proposes a process for re-drying wood by means of an equipment made of a conventional industrial batch kiln, a moisture level measuring device, and a high-frequency vacuum kiln (HFV) for re-drying wet pieces. The less strict variability criteria of the final moisture content for the commodity softwoods, produced in very large volume, allow a better possibility of return on investment of a batch HFV kiln for a re-drying application. The sole quality criterion regarding the moisture content for lumber (NLGA standard—National Lumber Grades Authority) is that the moisture content of the dried pieces be under 19% of moisture. The re-drying principle consists in stopping the batch drying cycle before the mean value of the wood moisture content reaches the target value (a few % above this value), carrying the pieces below 19% of moisture to the planer (or other transformation equipment), and re-drying the pieces remaining moist (above 19%) with the high-frequency vacuum. An advantage in doing this additional manipulation is that there are less over-heated pieces. The over-heating causes a greater shrinkage and consequently a more important warping, resulting in a more important potential downgrading of the products. A more important shrinkage imposes a certain oversizing of the sawings at the green state and thus a material yield loss.

The document "The Demonstration of Increased Lumber Value Using Optimized Lumber Sorting and Radio Frequency Vacuum Drying", Elustondo et al., Forest Prod. J. 55(1): 76-83, 2005, upholds that this technique would be economically advantageous.

However, the re-drying by high-frequency vacuum may prove to be less interesting on an economical point of view than the re-drying by conventional process. Moreover, currently, the industry does not seem convinced of the advantage of batch re-drying (by conventional method or other) since this process involves a lot of additional manipulations (as well as costs). Indeed, batch drying processes require human manipulations when stacking the pieces in the enclosure. Furthermore, the most difficult quality criterion to be obtained with the batch drying processes is a very low moisture variability around the desired target value (for example: it is easy to obtain a mean target of 15% but with some pieces at 7% and other ones at 25% of moisture). To achieve it, it is often necessary to take many additional processing hours inside the kilns.

U.S. Pat. No. 4,258,240 (Pless) proposes a continuous high-frequency process. But the process involves among other things a backward and forward moving of the wood stack, and periodic permutations of the electrode connexions to the generator and to the ground. Furthermore, the process applies to a stack of wood and does not satisfy the need of automatically selecting, controlling and ascertaining the moisture content of each one of the pieces and thus of limiting the necessity to have an operator to do it. The proposed process is rather akin to a semi-continuous application and is not adapted to purely continuous applications involving few or no manipulations.

SUMMARY

An object of the present invention is to provide a system and a method for continuous drying of wood pieces that allow really continuous applications involving few or no manipulations.

Another object of the present invention is to provide a system and a method for continuous drying of wood pieces that allow reducing the monitoring of conventional kilns.

Another object of the present invention is to provide a system and a method for continuous drying of wood pieces that allow eliminating or else reducing the number of pieces likely to be overdried.

Another object of the present invention is to provide a system and a method for continuous drying of wood pieces that allow improving the material yield at the sawmill.

Another object of the present invention is to provide a system and a method for continuous drying of wood pieces that allow better controlling the drying of wood and reaching more accurate moisture contents.

Another object of the present invention is to provide a system and a method for continuous drying of wood pieces that reduce the energy consumption.

Another object of the present invention is to provide a system and a method for continuous drying of wood pieces that allow increasing the yield of conventional batch kilns or that of other types of kilns.

Another object of the present invention is to provide a system and a method for continuous drying of wood pieces advantageously using high-frequency drying equipment.

According to an aspect of the invention, there is provided a method for continuous drying of wood pieces, comprising the steps of:

a) loading the wood pieces in file onto a conveyor arrangement defining a course towards a destination;

b) measuring a moisture content of each wood piece moving on the conveyor arrangement during the course;

c) diverting each wood piece whose measured moisture content is above a target moisture content from the conveyor arrangement towards a drying equipment capable of processing the wood pieces diverted in file for removing a portion of their moisture, the wood pieces whose measured moisture contents are below the target content continuing the course on the conveyor arrangement towards the destination;

d) passing each diverted wood piece in the drying equipment for removing a moisture portion from the wood piece;

e) measuring a moisture content of each wood piece after a drying cycle in the drying equipment;

f) repeating the steps d) and e) for each diverted wood piece whose measured moisture content after a drying cycle is above the moisture content target; and g) returning each diverted wood piece whose moisture content after a drying cycle is below the target moisture content onto the conveyor arrangement so that the wood piece resumes the course towards the destination.

According to another aspect of the invention, there is provided a system for continuous drying of wood pieces, comprising:

a conveyor arrangement capable of receiving and carrying the wood pieces in file along a course towards a destination;

a first measuring means for measuring a moisture content of each wood piece traveling on the conveyor arrangement during the course;

a diverting means for diverting from the conveyor arrangement each wood piece whose moisture content measured by the first measuring means is above a target moisture content, the wood pieces whose measured moisture contents are below the target content continuing the course on the conveyor arrangement towards the destination;

a drying equipment capable of receiving and processing in file the wood pieces diverted by the diverting means for removing a moisture portion from the wood pieces;

a second measuring means for measuring the moisture content of each wood piece processed by the drying equipment; and a means for selectively routing the wood pieces processed by the drying equipment towards the conveyor arrangement and again towards the drying equipment depending on whether the processed wood pieces have moisture contents measured by the second measuring means respectively below and above the target moisture content.

Preferably, the drying equipment is a high-frequency drying equipment.

BRIEF DESCRIPTION OF THE DRAWINGS

A detailed description of preferred embodiments of the invention will be given herein below with reference to the following drawings, in which like numbers refer to like elements.

DETAILED DESCRIPTION OF THE PREFERRED EMBODIMENTS

Figure 1:
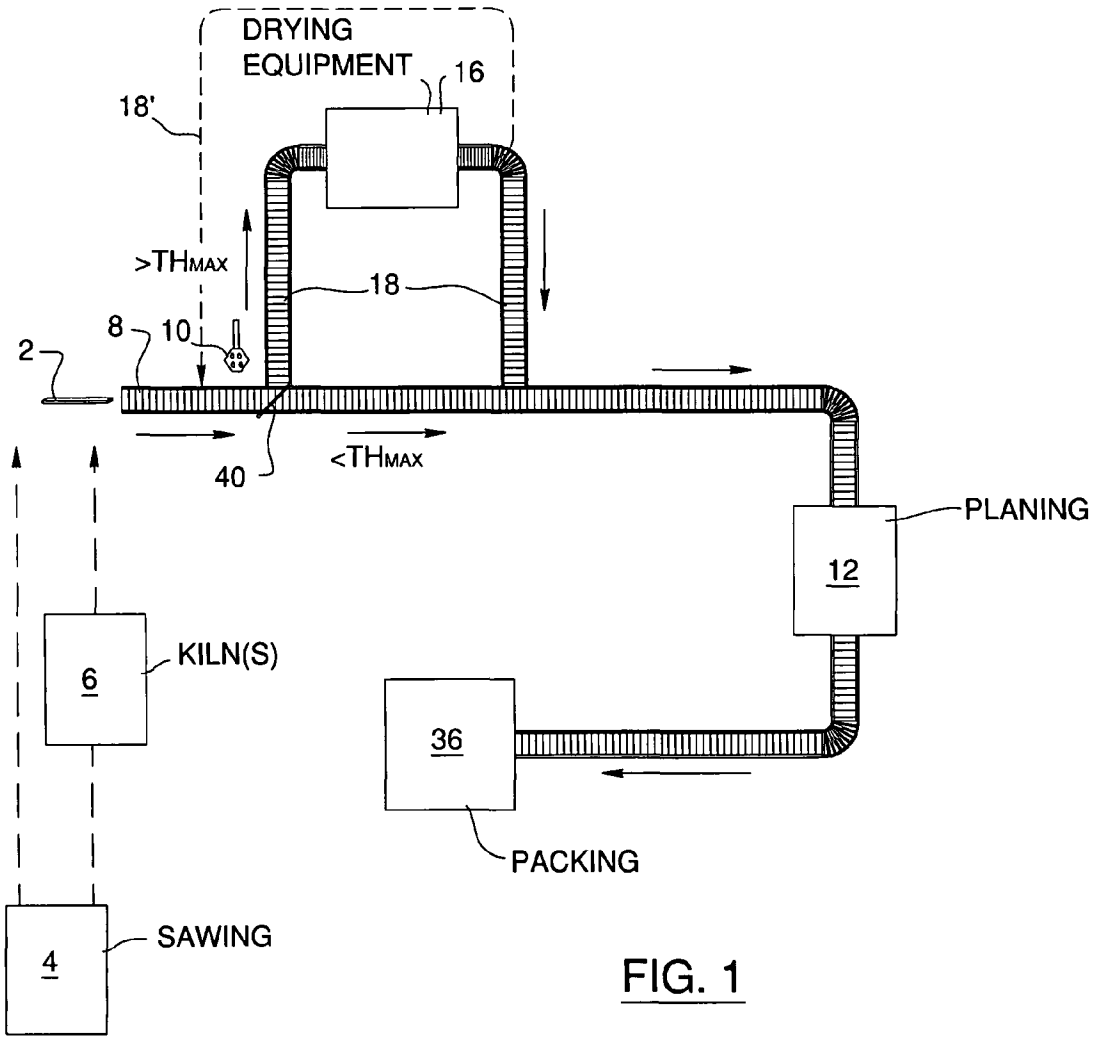
FIG. 1 is a schematic diagram of a system for continuous drying of wood pieces according to the invention.

Referring to FIG. 1, the drying method according to the invention allows drying (and re-drying) wood pieces 2 in a continuous mode without dedicated operator and without manipulation (requiring a human intervention). The wood pieces 2 may come, for example, from a sawmill 4, a timber yard, an external provider, kilns 6. The method uses a system comprising a conveyor arrangement 8 capable of receiving and carrying the wood piece in file along a course towards a destination, for example a planing station 12 and/or a packing station 36.

In connection with the present disclosure, the expression "in file" means that the wood pieces 2 are loaded onto the conveyor arrangement 8 so as to form a line or row that may have a width of several pieces 2 disposed next to and after one another and that may also overlap.

In connection with the present disclosure, the expression "drying" may be substituted to the expression "re-drying" and vice-versa since a re-drying operation consists in performing an additional drying operation, while a drying operation is involved in a re-drying operation of a wood piece 2. The system and method according to the invention may be used to dry green wood pieces 2, i.e. which have not yet been subjected to any drying operation, as well as wood pieces 2 having already been subjected to a preliminary drying, for example when they come from kilns 6. The wood pieces 2 may be in the form of boards, panels, sheets, shingles, components, or other forms if desired.

The conveyor arrangement 8 may be formed of a conveyor or several successive conveyors arranged to carry the wood pieces 2 to the desired destination. The conveyor arrangement 8 may be arranged so that the transportation arrangement of the wood pieces 2 is longitudinal, crosswise or in any angle with respect to a transportation direction of the conveyor arrangement 8.

The system comprises a first measuring device 10 for measuring a moisture content of each wood piece 2 travelling on the conveyor arrangement 8 during the course. The measuring device 10 may be of a type that takes a moisture content measurement of each wood piece 2 that passes in or under a predetermined detection area. The measuring device 10 may take any other desired configuration allowing measuring the moisture content of the wood pieces 2, preferably without hindering their displacement on the conveyor arrangement 8.

The system also comprises a diverting device 40 allowing diverting from the conveyor arrangement 8 each wood piece 2 whose moisture content measured by the first measuring device 10 is above a target moisture content ($>TH_{MAX}$). The wood pieces 2 whose measured moisture contents are below the target content ($<TH_{MAX}$) continue their course on the conveyor arrangement 8 towards the destination. The diverting device may take different forms and configurations. For example, it may be formed of a trapdoor that opens inside the conveyor arrangement 8 to divert the wood pieces 2 having a moisture content too high towards another course under the conveyor arrangement 8. It may also be formed of a pivoting arm arranged to divert the wood pieces 2 moving on the conveyor arrangement 8 towards one of its sides.

The system also comprises a drying equipment 16 capable of receiving and processing in file the wood pieces 2 diverted by the diverting device 40 to remove a moisture portion from the wood pieces 2. The drying equipment 16 is preferably by high-frequency. But the drying equipment 16 may also be by hot air convection, by thermal conduction of heat, by infrared, by microwaves, or by another thermal treatment technology that can modify the moisture content of the product.

The moisture content of each wood piece processed by the drying equipment 16 is measured by a second measuring device that may be formed by the first measuring device 10 or another one as described hereinafter, depending on the configuration of the system that is provided for selectively routing the wood pieces 2 processed by the drying equipment 16 towards the conveyor arrangement 8 and again towards the drying equipment 16 for a re-drying depending on whether the processed wood pieces 2 have moisture contents measured by the second measuring device respectively below and above the target moisture content.

In a typical mode of operation, the wood pieces 2 are loaded in file onto the conveyor arrangement 8 and are routed so as to pass under the in-line moisture content measuring device 10. When the measured moisture content of a piece 2 is below the target content, the piece 2 continues its course on the conveyor arrangement 8 and is routed toward the destination for example for a post-drying treatment such as planing 12, edging, varnishing, etc., possibly followed by packing 36. Such a piece 2 is thus not subjected to a drying or re-drying. When the measured moisture content of a piece 2 is above the target content, the piece 2 is automatically diverted by means of the diverting device 40 (formed of a diverting trapdoor or any other equivalent mechanism allowing diverting a wood piece 2) towards another conveyor arrangement 18 where the drying equipment 16 processes the piece 2 in a continuous mode in order to remove a portion of the wood moisture. The moisture content of each one of the pieces 2 processed by the equipment 16 is reappraised (in continuous mode) and when the pieces 2 are in conformity (content below the target content), they are routed by the conveyor arrangement 18 towards the conveyor 8 to eventually be subjected to the post-treatment operations. Otherwise, the wood pieces 2 are reprocessed by the drying equipment 16. In this way, the quality control is automatically and continually made, without letting the pieces 2 having a moisture content too high pass.

Figure 2:
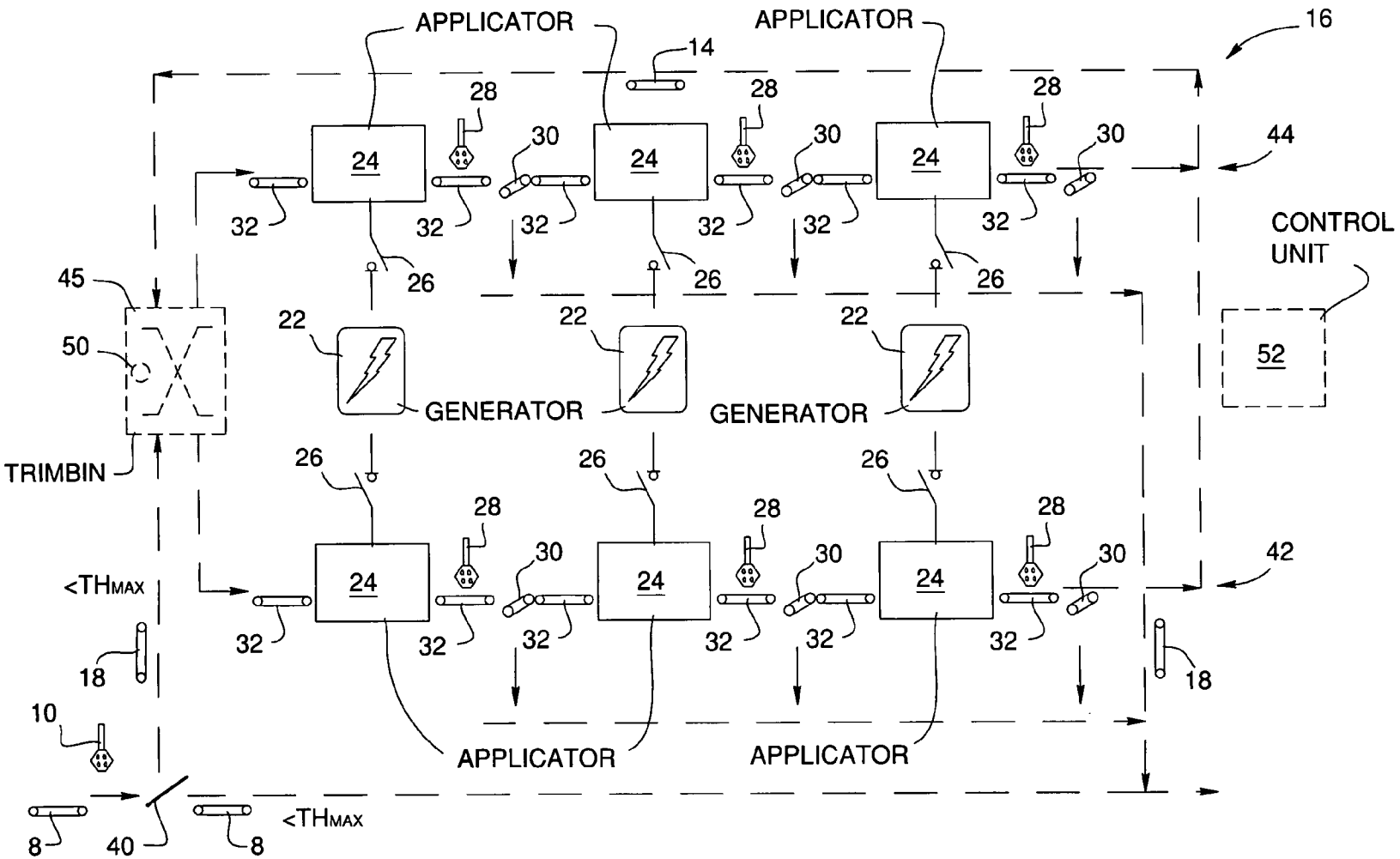
FIG. 2 is a schematic diagram of a high-frequency drying equipment of the system.

Referring to FIG. 2, a typical installation of a high-frequency drying equipment 16 implementable in a plant may mainly comprise generators 22, applicators 24, switches 26 for each one of the power lines, in-line moisture detectors 28, diverting trapdoors 30 and conveyors 14, 32.

The generators 22 are the sources that provide the electromagnetic energy to the applicators 24 at a frequency comprised for example between 1 MHz and 30 MHz (the frequency may be higher or lower with respect to the aforesaid range if desired). The applicators 24 transmit the energy from the generators 22 to the wood pieces 2 and generally consist of metallic electrodes 46, 48 (shown in FIGS. 3A, 3B, 3C and 3D). In-line moisture detectors 28 allow monitoring the moisture content of each one of the pieces 2 that move on the conveyors 32. The diverting trapdoors 30 (or other appropriate diverting devices) allow redirecting the pieces on the different lines of conveyors 32, 18, 14 depending on whether the pieces 2 have a moisture content above or below the target moisture contents. The high-frequency switches 26 allow the power to pass or not to the applicators 24 chosen to allow repair, maintenance and modification works.

The number and the power of the generators 22 used (to be installed) depend on the power required to perform the drying of the wood pieces 2, i.e. it is related to the production capacity of the plant and the amount of water to be evaporated. The applicators 24 are sized as a function of the chosen operating frequency, the available space, and their number is established as a function of the number of generators 22 and the number of lines 42, 44 (one, two, or more) chosen. The choice of the number of lines 42, 44 has an influence on the number of applicators 24 and on the number of components to be installed (line switches 26, moisture content detectors 28, conveyors 32, diverting trapdoors 30). The advantage of having multiple lines 42, 44 is to be capable of processing more wood pieces 2 but also to maintain a certain productivity for example during maintenance and repair operations on a line 42, 44.

The number of in-line moisture detectors 28 and diverting trapdoors 30 determines in part the moisture dispersion of the pieces 2 around the target value. The more there are trapdoors 30 and detectors 28, the closer the processed pieces 2 may be to the target moisture content. For equal conditions of moisture content, conveyor speed, power, etc., the dispersion (variation) of moisture will be higher for a drying line 42, 44 with only one detector 10 at the entry and one detector 28 at the exit than for a line 42, 44 that has detectors 28 and trapdoors 30 between each applicator 24. It is however possible to operate the lines 42, 44 with different dwell times (for example with different conveyor speeds) and/or at different powers in order to limit the number of in-line detectors 28 and trapdoors 30 while preserving a low dispersion. The wood pieces 2 to be subjected to the high-frequency drying are then separated and diverted towards either one of the lines 42, 44. For example, the fastest line 42, 44, i.e. having the shortest dwell time, may receive the wood pieces 2 that have a moisture content below a particular threshold, while the slowest one, i.e. with the longest dwell time, may receive the pieces 2 having a moisture content above the particular threshold.

The priority of the wood pieces 2 is preferably considered. A piece 2 that comes out at the end of the line 42, 44 and that has not yet reach the target moisture content will preferably have priority to be re-dried with respect to a new piece 2 that comes in for the first time in the drying equipment 16. The prioritization of the pieces 2 allows avoiding a too large temperature drop prior to the re-drying during a second pass through the equipment 16, which translates in an energy saving and a better yield of the installations. A simple way to achieve the prioritization is to use a trimbin 45 with a piece detector 50 that triggers the admission of the wood piece 2 on the line 44, 42 and that temporarily limits the access to the new wood pieces 2. Thus, the wood pieces 2 that have not yet reach the target moisture content are re-injected as fast as possible in the re-drying line 42, 44.

The control of the operations of the system may be centralized for example by means of a control unit 52 analyzing the measurements coming from the measuring devices 10, 28, controlling the diverting trapdoors 30, 40, and operating the conveyors 8, 14, 32 if necessary. The control of the operations may also be decentralized, for example, for each arrangement of measuring device 10, 28 and of diverting device 30, 40, possibly including the sections of the conveyor arrangements 8, 14, 32 close to these elements.

Figure 3A:
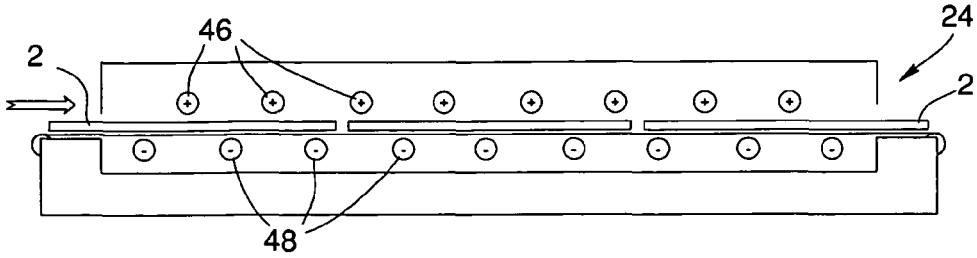
FIGS. 3A, 3B, 3C and 3D are schematic diagrams illustrating types of possible applicators for the system.
Figure 3B:
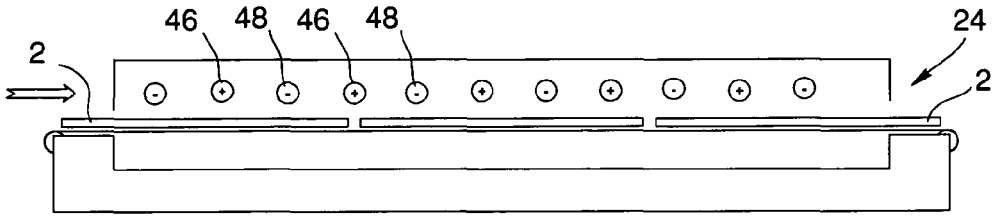
Figure 3C:
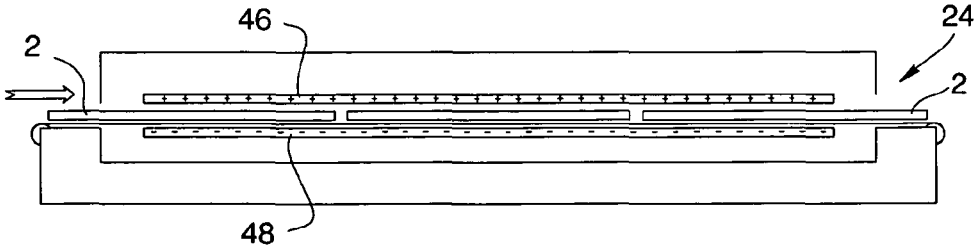
Figure 3D:
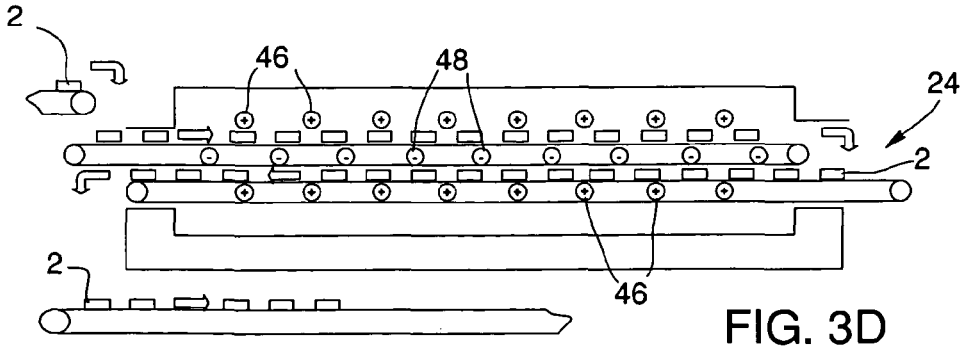

Referring to FIGS. 3A, 3B, 3C and 3D, the applicators 24 may be built with different configurations of electrodes 46, 48. Three configurations possibly the most appropriate for the case of continuous re-drying are with alternate bars 46, 48 (electrodes) as illustrated in FIG. 3A, with stray field bars 46, 48 (electrodes) as illustrated in FIG. 3B, and with an applicator having plates 46, 48 (electrodes) as illustrated in FIG. 3C. The dimensions (length and width) of the applicators 24 depend on the frequency used. It is possible to reduce the required floor space by building double or multi-pass applicators 24 as illustrated in FIG. 3D, or vertical applicators (not shown).

Each one of the types of applicators 24 has advantages and drawbacks at the level of the design and the costs. The stray field applicators 24 (illustrated in FIG. 3B) are possibly the most appropriate ones for thin or very thin wood pieces 2. For medium thickness wood pieces 2, alternate bar applicators 24 (illustrated in FIG. 3A) are preferable although not compulsory. For thick wood pieces 2, plate applicators 24 (illustrated in FIG. 3C) may prove to be the most appropriate ones. In the case of a plate applicator 24, the moving orientation of the wood pieces 2 (longitudinal or crosswise) has no or little influence and thus the design of electrodes 46, 48 is simple. In the case of bar or stray field applicators 24, the orientation of the wood pieces 2 in motion has an influence on the design and the orientation of the electrodes 46, 48. The choice of applicator is function of the types of products to be processed and the desired final results.

Figure 4A:
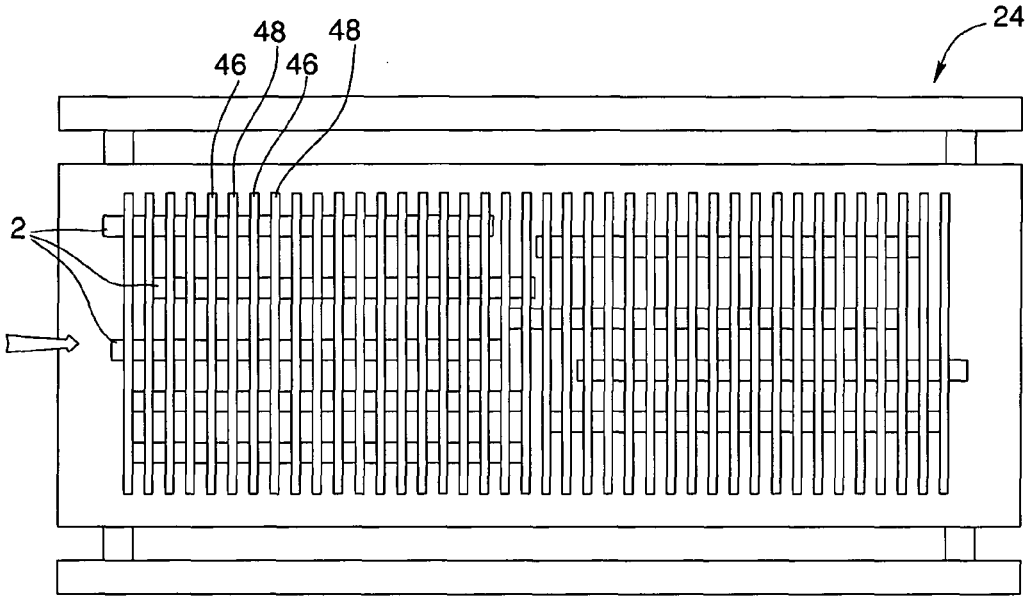
FIGS. 4A and 4B are top views of possible configurations of applicators for the system.
Figure 4B:
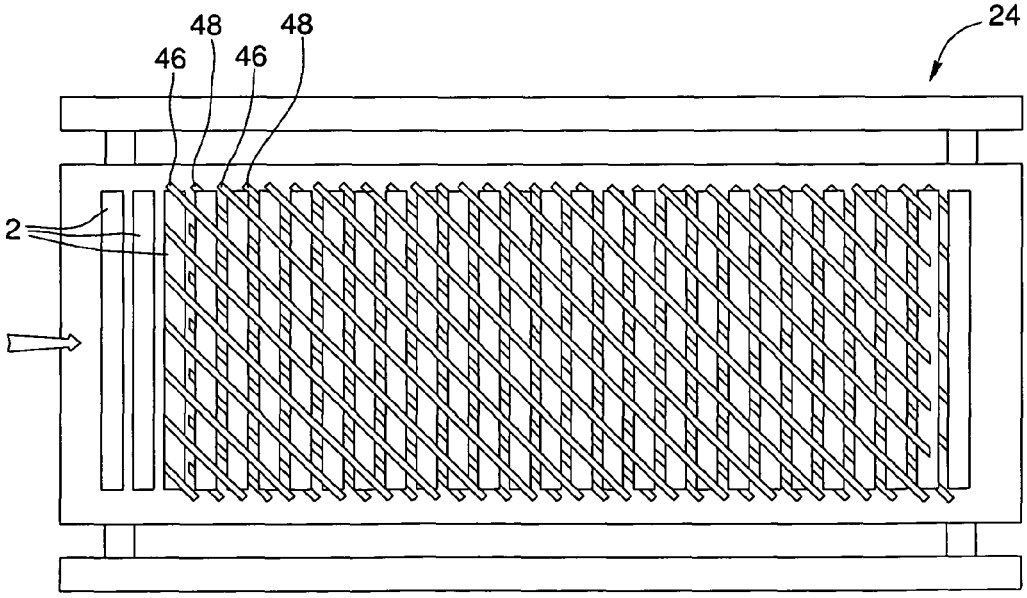

Referring to FIGS. 4A and 4B, in the case of a longitudinal moving of the pieces 2, the bars 46, 48 may be positioned crosswise as illustrated in FIG. 4A or at an angle as illustrated in FIG. 4B with respect to the wood pieces 2. However, in the case of a crosswise moving, the bars 46, 48 should preferably be positioned at an angle as illustrated in FIG. 4B to ensure that the wood pieces 2 are evenly heated, no matter their position in the applicator 24.

Referring back to FIG. 1, by its design, the system according to the invention may be inserted at the exit of a sawing line 4, before or after the planing 12, and before or after any other transformation step so as to eliminate the usual transportation manipulations from the sawmill towards the kilns 6 (conventional method) followed by the transportation of the wood from the kilns 6 to the planer line 12. This configuration is then useful to dry wood from green state to dry state. The system according to the invention is particularly useful to perform a re-drying of wood pieces 2 (for example coming from conventional kilns 6 or from pre-dried wood). In that case, it is possible, and sometimes preferable, to prematurely stop the conventional drying so as to eliminate or else limit the overdrying, the defects and the costs related thereto. The system according to the invention allows a reduction of the monitoring of the conventional kilns 6 since the stopping point is less critical. The system also results in a limitation of the over-dried wood pieces 2. The system also allows a reduction of the target values at the sawing, thus an increase of the material (wood) yield since there is less shrinkage (on average). There is also a limitation of the "green" pieces since the moister pieces automatically pass again in the high-frequency dryer 16 when they are not below the acceptable moisture content threshold. There is few or no additional manipulations of the wood, while providing a global reduction of the specific energy consumption. Furthermore, it allows an improved conformity of the moisture content of the finished product.

In a simplified version, the portion of the conveyor arrangement 18 downstream from the drying equipment 16 may be diverted such as depicted by the dashed line 18' to systematically bring the wood pieces 2 processed by the drying equipment 16 back onto the conveyor arrangement 8 upstream from the measuring device 10, so as to define a re-drying loop followed by the wood pieces as long as their moisture content measured by the measuring device 10 is not below the target content. Such a simplified version allows eliminating the measuring device(s) 28 (shown in FIG. 2) and the diverting trapdoors 30 (shown in FIG. 2). The functions of the measuring devices 28 and of the diverting trapdoors 30 are then fulfilled by the measuring device 10 and the diverting device 40.

Referring to FIG. 2, the conveyor arrangements 14, 18, 32 carrying the wood pieces 2 around and through the drying equipment 16 may form different configurations of lines and courses, may have common or shared sections, and may include other diverting and detecting devices or mechanisms and other similar equipments for the transportation and routing of the wood pieces 2 through the system.

The measuring devices 10, 28 for measuring the moisture content of the wood pieces 2 may be of different types, for example, capacitive, resistive, or others. The capacitive types of devices may in particular operate linearly or crosswise. The measuring principle consists in creating a high-frequency electrical field within the material (wood) and measuring the permittivity and/or measuring the variation of the oscillation frequency with respect to the circuit without material and/or the loss factor of the material (wood). The measured values are influenced by the moisture content of the wood and the relations are generally well mastered in a certain range of moisture content. The reading provided by such a type of device often corresponds to a moisture content expressed in %. The measurement is performed with or without contact and may easily be carried out in continuous mode. For resistive type devices, the measuring operation is generally performed crosswise. The measuring principle consists in passing a current between the electrodes and measuring the electrical resistance (or the conductance). The relation between the electrical resistance (or conductance) and the moisture content of the wood is well mastered. The reading provided by the device generally corresponds to a moisture content expressed in %.

Figure 5:
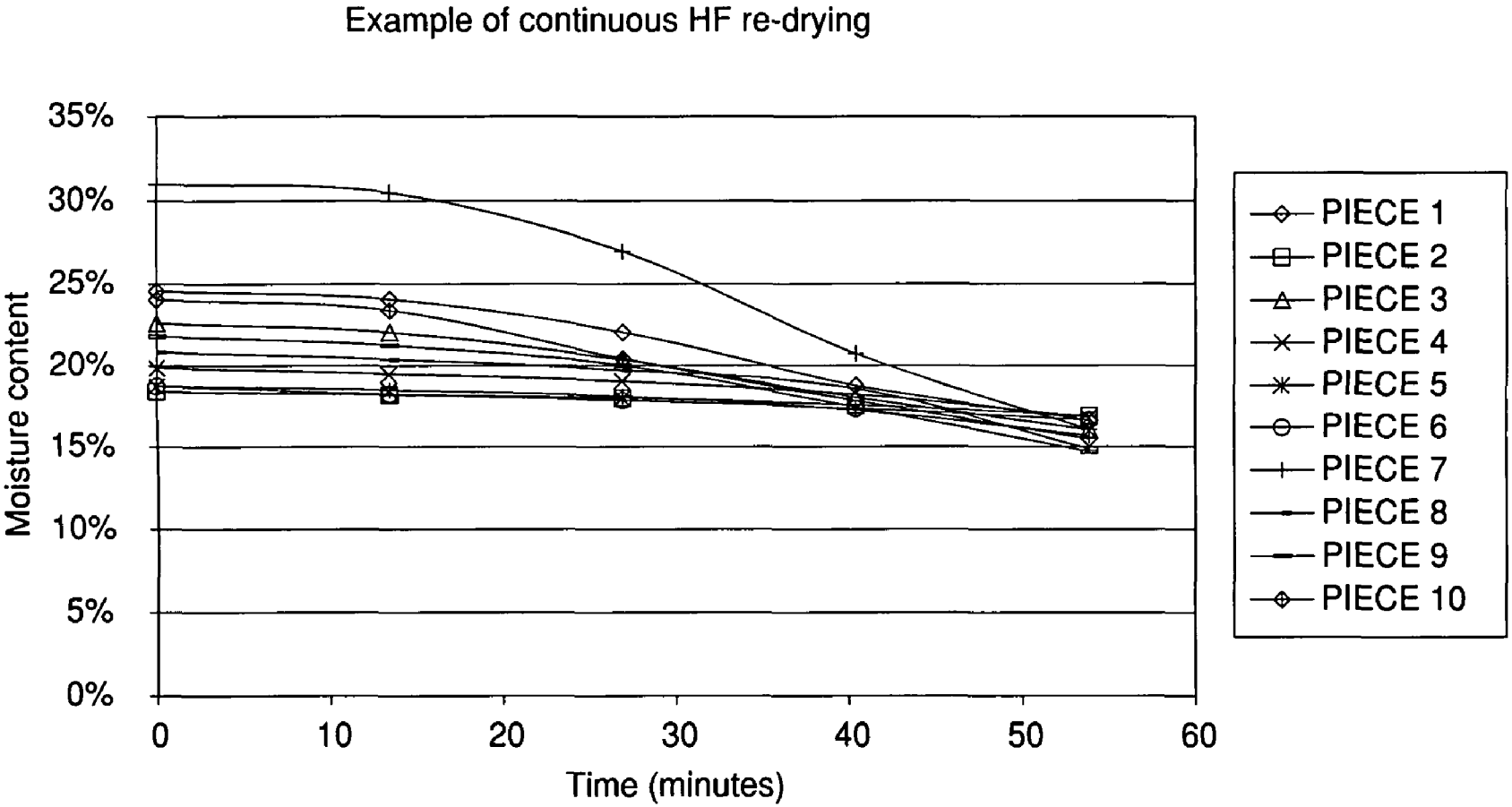
FIG. 5 is a graph illustrating the evolution of the moisture content of wood pieces during successive re-drying operations in the system.

Referring to FIG. 5, there is shown a graph exhibiting the typical evolution of the moisture content of pieces dried in continuous mode in a high-frequency dryer-conveyor 16 (shown in FIG. 1) at reduced scale (1.5 m of length). Each point represents a moment in time where the piece 2 has been weighed at the exit of an applicator and has been then reintroduced at the entry thereof (to simulate a second applicator). The drying curves have been built with 4 "passes" in the line (simulating four successive applicators). If, for example, the moisture content is measured at the exit of the line and the target value is 20%, the piece #1 will be extracted from the system on the third pass (or after 40 minutes). The piece #2 will not be processed by the system (since its moisture content is already below 20%). The piece #3 will be extracted after 2 passes (12 minutes). Etc. A great quality of the process is that the moisture content of each one of the pieces 2 may be measured between each applicator 24 in order to extract it from the system as soon as its moisture content is slightly below the target value.

Tests have allowed establishing that the quality of spruce wood processed in a high-frequency drying system according to the invention was comparable or else better in terms of warp of pieces of 2 inches×4 inches (2×4) with respect to conventionally re-dried pieces. Furthermore, the tests have allowed establishing the processing time to less than one hour for this type of wood with an acceptable quality.

The operation proves to be extremely simple and the costs of an industrial equipment may be below the costs for the HFV technology (high-frequency vacuum batch kilns) currently available.

While embodiments of the invention have been illustrated in the accompanying drawings and described above, it will be evident to those skilled in the art that modifications may be made therein without departing from the invention.

The invention claimed is:

1. A method for continuous drying of wood pieces, comprising the steps of:

a) loading the wood pieces in file onto a conveyor arrangement defining a course towards a destination;

b) measuring a moisture content of each wood piece moving on the conveyor arrangement during the course;

c) diverting each wood piece whose measured moisture content is above a target moisture content from the conveyor arrangement towards a drying equipment capable of processing the wood pieces diverted in file for removing a portion of their moisture independently from their measured moisture content, the wood pieces whose measured moisture contents are below the target content continuing the course on the conveyor arrangement towards the destination;

d) passing each diverted wood piece in the drying equipment for removing a moisture portion from the wood piece;

e) measuring a moisture content of each wood piece after a drying cycle in the drying equipment;

f) repeating the steps d) and e) for each diverted wood piece whose measured moisture content after a drying cycle is above the moisture content target; and g) returning each diverted wood piece whose moisture content after a drying cycle is below the target moisture content onto the conveyor arrangement so that the wood piece resumes the course towards the destination.

2. The drying method according to claim 1, wherein the wood pieces to be re-dried according to the step f) have priority over the wood pieces that have just been diverted at the step c).

3. The drying method according to claim 1, wherein the steps e) and f) are respectively performed by repetitions of the steps b) and c).

4. The drying method according to claim 1, wherein the drying equipment comprises processing lines having different dwell times for the wood pieces, the step c) including a selective diverting of the wood pieces towards one of the lines depending on the moisture content of the wood pieces measured at the step b).

5. The drying method according to claim 1, wherein the drying equipment is a high-frequency drying equipment.

6. A system for continuous drying of wood pieces, comprising:

a conveyor arrangement capable of receiving and carrying the wood pieces in file along a course towards a destination;

a first measuring means for measuring a moisture content of each wood piece traveling on the conveyor arrangement during the course;

a diverting means for diverting from the conveyor arrangement each wood piece whose moisture content measured by the first measuring means is above a target moisture content, the wood pieces whose measured moisture contents are below the target content continuing the course on the conveyor arrangement towards the destination;

a drying equipment capable of receiving and processing in file the wood pieces diverted by the diverting means for removing a moisture portion from the wood pieces independently from their measured moisture content;

a second measuring means for measuring the moisture content of each wood piece processed by the drying equipment; and a means for selectively routing the wood pieces processed by the drying equipment towards the conveyor arrangement and again towards the drying equipment depending on whether the processed wood pieces have moisture contents measured by the second measuring means respectively below and above the target moisture content.

7. The drying system according to claim 6, wherein the means for routing comprises an additional conveyor arrangement capable of receiving and bringing the wood pieces processed by the drying equipment back onto the conveyor arrangement upstream from the first measuring means, the conveyor arrangement having a portion forming, with the diverting means, the drying equipment and the additional conveyor arrangement, a loop for successive re-dryings of the wood pieces whose moisture contents measured by the first measuring means are above the target moisture content.

8. The drying system according to claim 7, wherein the second measuring means is formed by the first measuring means, and the means for routing comprises the diverting means.

9. The drying system according to claim 6, wherein the means for routing comprises a first additional conveyor arrangement capable of receiving and bringing the wood pieces processed by the drying equipment back towards the drying equipment for a re-drying of the wood pieces, a second additional conveyor arrangement capable of receiving and bringing the wood pieces processed by the drying equipment back onto the conveyor arrangement downstream from the diverting means, and an additional diverting means for diverting the wood pieces processed by the drying equipment whose moisture content measured by the second measuring means are below the target content towards the second additional conveyor arrangement, the wood pieces processed by the drying equipment whose moisture contents measured by the second measuring means are above the target moisture content continuing a course on the first additional conveyor arrangement bringing them back to the drying equipment.

10. The drying system according to claim 6, wherein:

the first measuring means comprises an in-line moisture detector disposed along the conveyor arrangement; and the diverting means is disposed along the conveyor arrangement downstream from the first measuring means.

11. The drying system according to claim 6, wherein the drying equipment is a high-frequency drying equipment and comprises at least one drying arrangement having a high-frequency generator for providing an electromagnetic energy and an applicator for transmitting the electromagnetic energy to the wood pieces passing in the applicator for removing a moisture portion in the wood pieces.

12. The drying system according to claim 11, wherein the applicator comprises electrodes having a configuration of alternate bars, stray field bars, or plates.

13. The drying system according to claim 12, wherein the electrodes of the applicator have a configuration of alternate bars or of stray field bars, and the bars extent at an angle with respect to a longitudinal axis of the pieces passing in the applicator.

14. The drying system according to claim 6, wherein:

the drying equipment comprises drying arrangements disposed in series and forming at least one re-drying line;

the second measuring means comprises moisture content measuring devices respectively disposed at exits of the drying arrangements along the re-drying line; and the means for routing comprises a first additional conveyor arrangement capable of carrying the wood pieces through the re-drying line and bringing the wood pieces reaching an end of the re-drying line back again at a beginning of the re-drying line, diverting trapdoors disposed along the first additional conveyor arrangement respectively past the drying arrangements downstream from the measuring device and operating as a function of the moisture contents measured by the measuring devices at exits of the drying arrangements, and a second additional conveyor arrangement capable of receiving the wood pieces diverted by the trapdoors and bringing them back onto the conveyor arrangement.

15. The drying system according to claim 14, wherein the drying equipment comprises several re-drying lines in parallel.

16. The drying system according to claim 15, wherein the drying equipment is a high-frequency drying equipment comprising high-frequency generators for providing an electromagnetic energy, and applicators for transmitting the electromagnetic energy to the wood pieces passing in the applicators for removing a moisture portion in the wood pieces.

17. The drying system according to claim 16, wherein the drying arrangements of the lines share the high-frequency generators, and the high-frequency drying equipment comprises switches between the high-frequency generators and the applicators.

18. A system for drying of wood pieces, comprising:

a conveyor that receives and carries the wood pieces in file along a course towards a destination;

a first measuring device that measures a moisture content of each wood piece traveling on the conveyor along the course;

a diverter that diverts from the conveyor each wood piece whose moisture content measured by the first measuring device is above a target moisture content, the wood pieces whose measured moisture contents are below the target content continuing the course on the conveyor towards the destination;

a drying equipment that receives and processes in file the wood pieces diverted by the diverter for removing a moisture portion from the wood pieces independently from their measured moisture content;

a second measuring device that measures the moisture content of each wood piece processed by the drying equipment; and a routing device that selectively routes the wood pieces processed by the drying equipment towards the conveyor and again towards the drying equipment depending on whether the processed wood pieces have moisture contents measured by the second measuring device respectively below and above the target moisture content.

19. The drying system according to claim 18, wherein the routing device includes an additional conveyor that receives and brings the wood pieces processed by the drying equipment back onto the conveyor upstream from the first measuring device, the conveyor having a portion forming, with the diverter, the drying equipment and the additional conveyor, a loop for successive re-dryings of the wood pieces whose moisture contents measured by the first measuring device are above the target moisture content.

20. The drying system according to claim 18, wherein the drying equipment includes drying devices disposed in series and forming at least one re-drying line, wherein the second measuring device includes moisture content measuring devices respectively disposed at exits of the drying arrangements along the re-drying line, and wherein the routing device includes:

a first additional conveyor that carries the wood pieces through the re-drying line and brings the wood pieces reaching an end of the re-drying line back again at a beginning of the re-drying line;

diverting trapdoors disposed along the first additional conveyor respectively past the drying arrangements downstream from the measuring device and operating as a function of the moisture contents measured by the measuring devices at exits of the drying arrangements; and a second additional conveyor that receives the wood pieces diverted by the trapdoors and brings them back onto the conveyor.

* * * * *